United States Patent [19]

Lipps

[11] Patent Number: 4,971,325

[45] Date of Patent: Nov. 20, 1990

[54] GOLF PRACTICE APPARATUS

[76] Inventor: John D. Lipps, 1514 Ridgecrest Dr., Kent, Ohio 44240

[21] Appl. No.: 493,579

[22] Filed: Mar. 6, 1990

[51] Int. Cl.[5] ..... A63B 69/36

[52] U.S. Cl. ..... 273/183 B; 273/186 A; 273/193 R; 273/310

[58] Field of Search ..... 273/183 R, 186 A, 183 A, 273/183 D, 193 R, 310

[56] References Cited

U.S. PATENT DOCUMENTS

| | | | |
|---|---|---|---|
| 3,953,034 | 2/1976 | Nelson | 273/186 C |
| 4,146,230 | 3/1979 | Foster | 273/186 R |
| 4,304,406 | 12/1981 | Cromarty | 273/186 R |
| 4,306,722 | 12/1981 | Rusnak | 273/186 R |
| 4,451,043 | 5/1984 | Ogawa et al. | 273/186 R |
| 4,456,257 | 6/1984 | Perkins | 273/186 R |
| 4,502,035 | 2/1985 | Obenauf et al. | 273/183 B |
| 4,693,479 | 9/1987 | McGwire | 273/186 A |
| 4,758,000 | 7/1988 | Cox | 273/190 R |
| 4,858,934 | 8/1989 | Ladick et al. | 273/186 A |

*Primary Examiner*—George J. Marlo
*Attorney, Agent, or Firm*—John L. Gray

[57] ABSTRACT

An apparatus for the practicing of golf swings utilizing a beam from the forehead of the user coordinated with the swing of an actual golf club in contact with a golf ball, or simulated golf club in contact with a simulated golf ball. In the case of the simulated unit which may be used indoors, details of club head registry, swing, follow through, and distance the ball travels are displayed and recorded.

15 Claims, 4 Drawing Sheets

FIG. 2
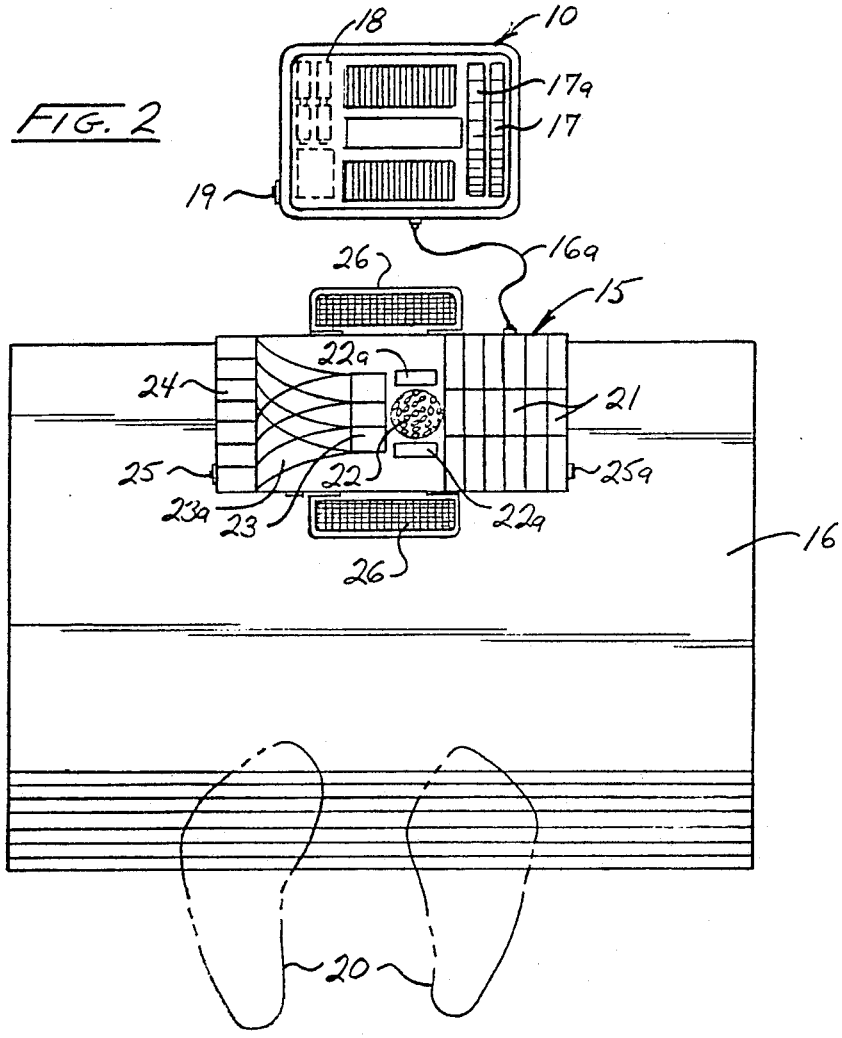
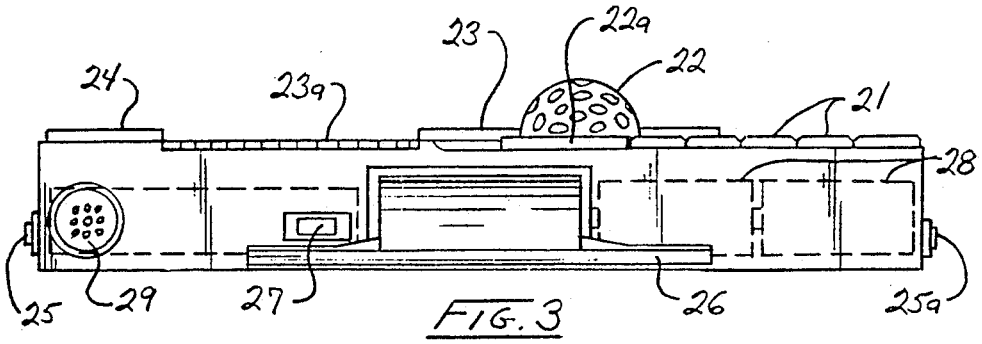
FIG. 3

GOLF PRACTICE APPARATUS

BACKGROUND OF THE INVENTION

It is important in achieving a good result in playing golf to both hit the ball correctly with the club head as well as follow through with the club head properly. It is equally important that the head of the golfer be so positioned that his eye is on the ball at the right instant. Specifically, the head should follow the club. If the ball is hit correctly, the movement of the head will be such that it will be directly over and in line with the ball an instant after the club hits the ball. As far as we know no one has considered the second element with respect to golfer head movement in golf practice apparatus, although there is considerable prior art in golf practice devices that may be used in conjunction with club head position and club head follow through and also devices which measure the impact of the golf club on the golf ball.

For example, U.S. Pat. No. 4,137,566, issued Jan. 13, 1987 to Steven L. Haas, et al., utilizes light sources attached to appropriate locations on the golfer or on a golf club, the light from these sources being detected by sensors. The output from these sensors are electronically processed to provide alphanumeric or graphic data for display. In order to use this device a golfer must swing a golf club which is impractical in many homes because of the low ceilings in most homes.

U.S. Pat. No. 4,254,956, issued Mar. 10, 1981 to Thomas L. Rusnak, discloses apparatus for photoelectrically sensing the timed position of a golf club head at selected stations along the practice swing. The characteristics of the swing and the resulting ball flight are computed electrically and displayed to the player. This device requires the use of a real golf club.

U.S. Pat. No. 4,542,906, issued Sept. 24, 1985 to Akio Takcase, et al., discloses a computer aided golf training device which detects movement of a golf ball immediately after the ball has been impacted by a club head. This requires the use of a golf club and also that a ball be struck and must, as a practical matter, be used outside.

U.S. Pat. No. 4,858,934, issued Aug. 22, 1989, to Ladick, et al., discloses a golf practice apparatus which utilizes a simulated golf club provided with a light source therein and when this is swung the movement of the simulated golf club is detected by an array of sensors which in turn produce signals which are processed in turn to produce output signals corresponding to the speed and orientation of the simulated golf club and this information is then visually displayed on a computer screen, usually in the form of a picture illustrating the flight of a golf ball, the flight varying in dependence on various characteristics of the swinging of the simulated golf club.

BRIEF SUMMARY OF THE INVENTION

The present invention utilizes a radiation source on the forehead of the user which projects forwardly from the user's forehead and is detected by a unit contemporaneously with the golfer's swinging either a golf club, if he is outside, or a simulated golf club provided with beams of radiation emanating from one end thereof.

If the device is used outside, it is used in conjunction with a detector which detects when the golf ball is hit by the club and compares this information with the position of the head of the golfer at the time of impact.

For indoor use, the head position detector may be attached to a device containing a simulated golf ball and sensors having incorporated therein lights which will indicate the position of the club upon impact with a simulated golf ball, the speed of the club, the position of the club at the time of contact with the simulated golf ball, and the follow through of the swing of the simulated club.

It is therefore an object of this invention to provide a golf practice apparatus which will detect the position of the user's head at the time of impact of either a golf club with a golf ball or a simulated golf club with a simulated golf ball in the case of indoor usage.

It is a further object of this invention to provide such a device which will compare the position of the golfer's head at the time of impact of the golf club with the golf ball or the golf club simulator with the simulated golf ball and provide this information visually and, if desired, audibly, to the golfer.

It is a further object of this invention to provide a comparison of the position of the golfer's head at the time of impact of a simulated golf club with a simulated golf ball and also measure the position of the simulated club head at the time of impact, the swing path of the club head, and the follow through of the club head.

These, together with other objects and advantages of the invention will become more readily apparent to those skilled in the art when the following general statements and descriptions are read in the light of the appended drawings.

BRIEF DESCRIPTION OF THE DRAWINGS

FIG. 2 is a plan view of applicant's invention for indoor use.

FIG. 3 is a side elevation view of the simulated golf ball and sensors and display devices associated therewith.

DETAILED DESCRIPTION OF THE INVENTION

Figure 1:
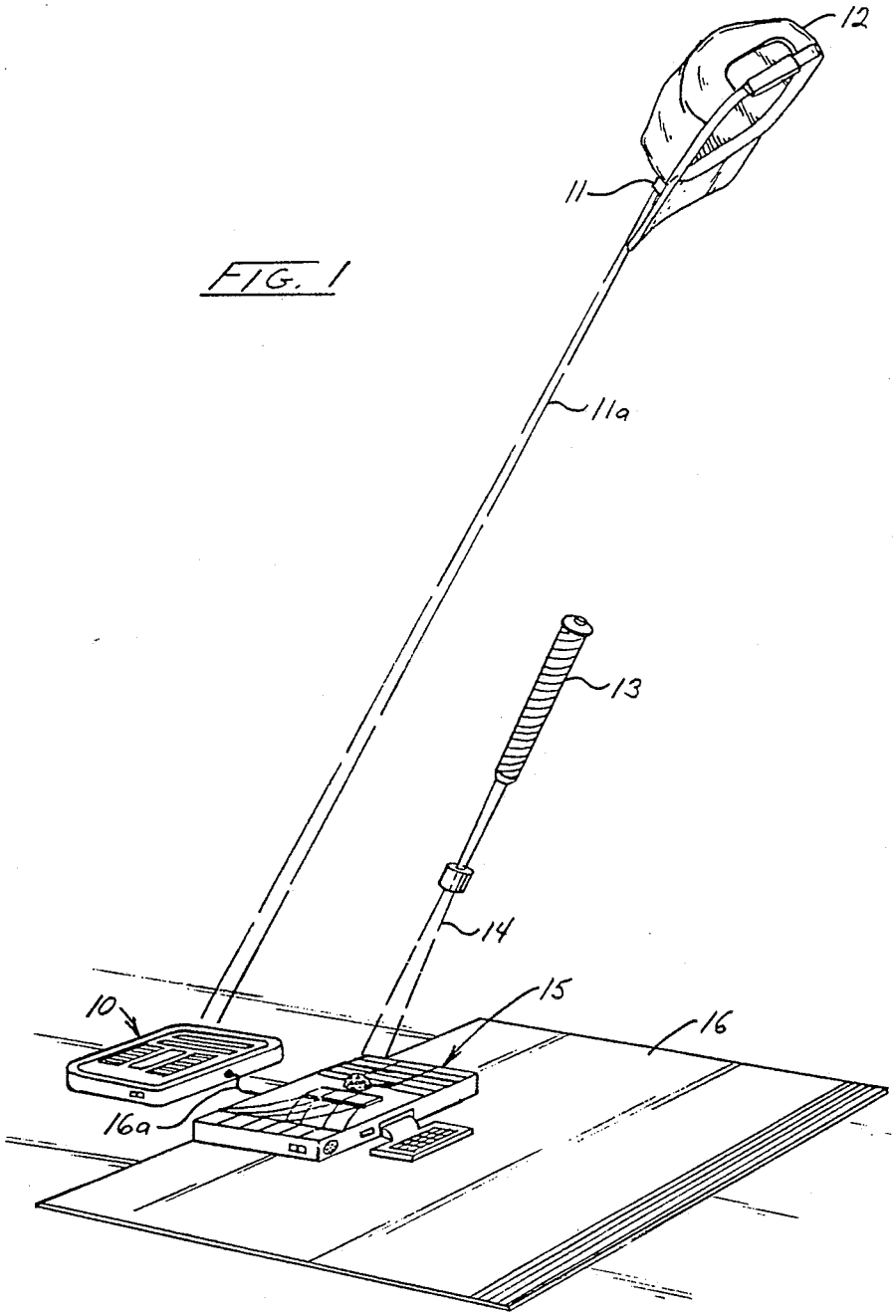
FIG. 1 is a perspective view of applicant's invention for indoor use.

Referring more particularly to FIG. 1, the receptor for the radiation beam from the head of the user is shown generally at 10 with the source 11 positioned on a cap which could be worn by the user. 11*a* is a beam of radiation from the source 11. This radiation beam 11*a* can be visible light or a radio frequency beam or a comparable form of radiation. The simulated golf club 13 is shown emanating rays of light 14 onto the sensing and recording device for home use 15 mounted on a mat 16 and connected to receptor 10 by electrical lead 16*a*.

Referring now more particularly to FIG. 2, the receptor 10 is shown with a sensor and light display 17 for detecting the beam of radiation 11*a* and displaying this information. The impact motion sensor and light display 17*a* and portable DC power source shown in outline 18 with on/off switch 19 are also shown. Mat 16 is shown with the superimposed position of the golfer's feet 20 in phantom placed thereon and connected to receptor 10 by lead 16*a*. The recording and detecting device 15 is shown provided with a plurality of registers 21—21 for displaying distance traveled by the ball, club path, follow through, scoring accumulation, distance accumulation, and swing count. A simulated golf ball 22, sensor 22*a* for detecting club head alignment upon impact with the simulated golf ball 22, sensor 23 for detecting speed of struck simulated golf ball 22, golf club simulated swing path detectors and light displays 23*a*—23*a*, and sensors and light displays 24—24 for detecting follow through movement of the club head during the swing are also shown. The recording device 15 is provided with an on/off switch 25 and foot reset pedals 26—26. The club head selection switch 25*a* may be set by the user to identify the club he wishes to use. This will directly affect the distance that the simulated golf ball 22 will travel.

Referring now more particularly to FIG. 3, the simulated golf ball 22 is shown along with the registers 21—21, the club head alignment sensor 22*a*, the speed detecting sensor 23, golf club simulated swing path detectors and light displays 23*a*—23*a*, and follow through sensors and light displays 24—24. The on/off switch 25 is provided, as are the club head selection switch 25*a* and a memory recall button 27. The unit may be operated by AC or DC power sources and shown in outline are batteries 28—28 for DC use. An audio response speaker is shown at 29.

Figure 4:
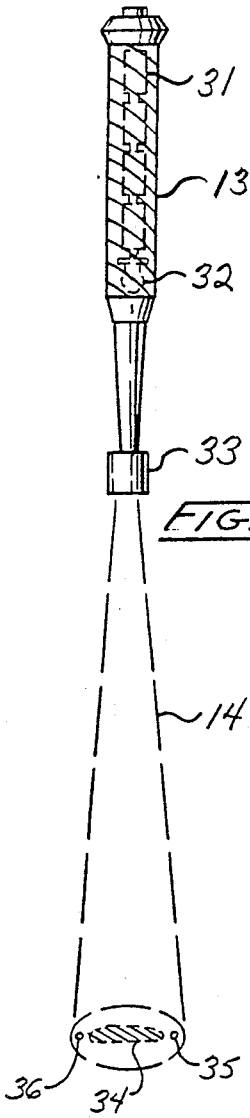
FIG. 4 is a side elevation view of the simulated golf club showing the image presented by it for the benefit of the user.

Referring now more particularly to FIG. 4, the simulated golf club is shown at 13 containing DC power source 31 and is provided with appropriate bulbs 32—32 and a weight 33 to produce a collective weight of the golf club comparable to that of a conventional club. This simulated golf club 13 displays a golf club head 34 from a vertical viewpoint as well as two infrared beams at the toe and the heel of the golf club head 34 shown respectively at 35 and 36. These infrared beams actuate the various sensors in the device shown in FIG. 3 so that ambient light does not provide false results.

Figure 5:
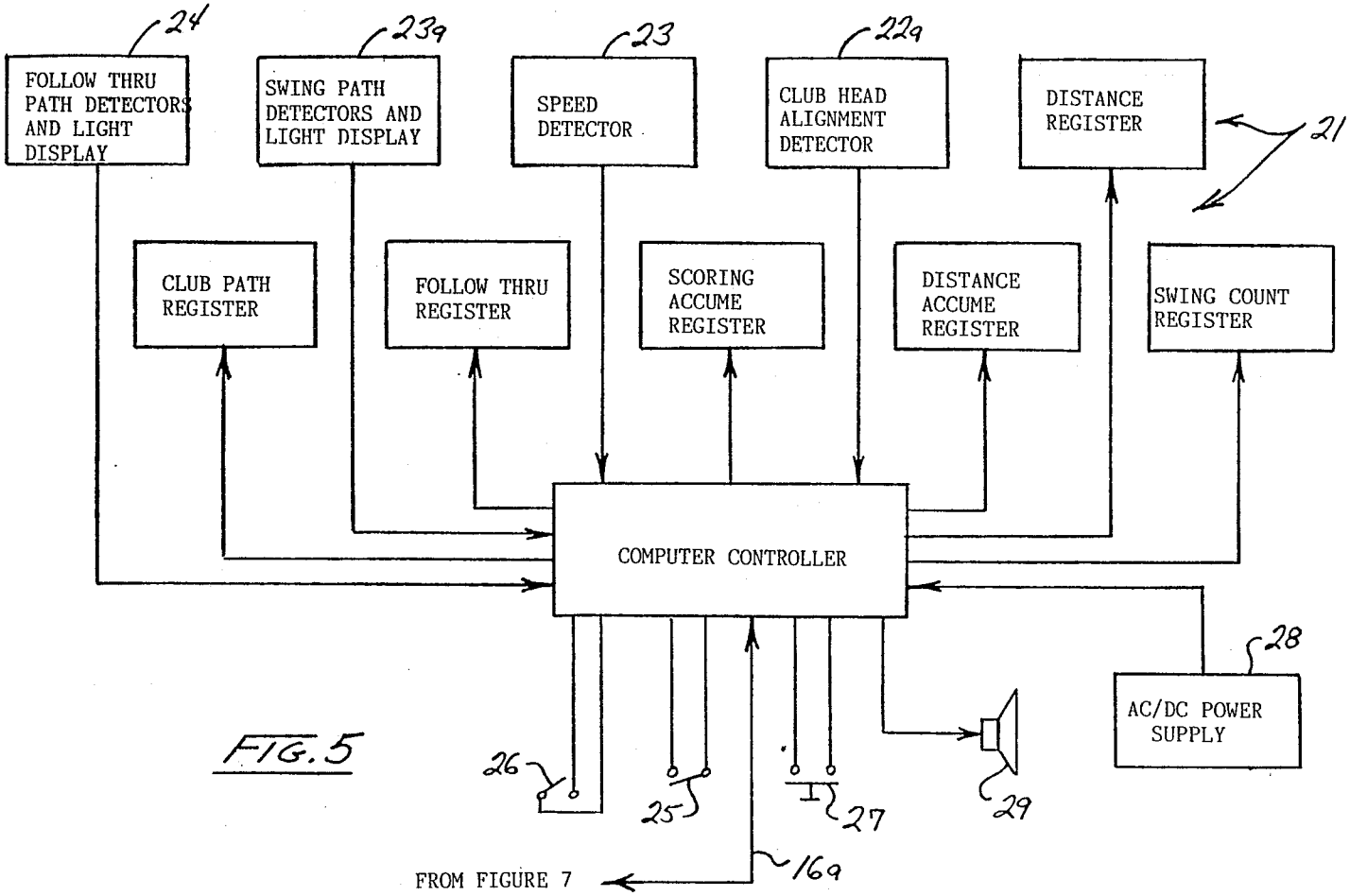
FIG. 5 is a schematic wiring diagram of the device of FIG. 3.

FIG. 5 is a schematic wiring diagram of the device shown in FIG. 3 with the various registers shown generally at 21—21 and the club head alignment detector 22*a*, the speed detector 23, the swing path detector and light displays shown at 23*a*—23*a*, and the follow through path detectors and light displays 24—24. All of this information is fed into a computer controller provided with an AC/DC power supply.

Figure 6:
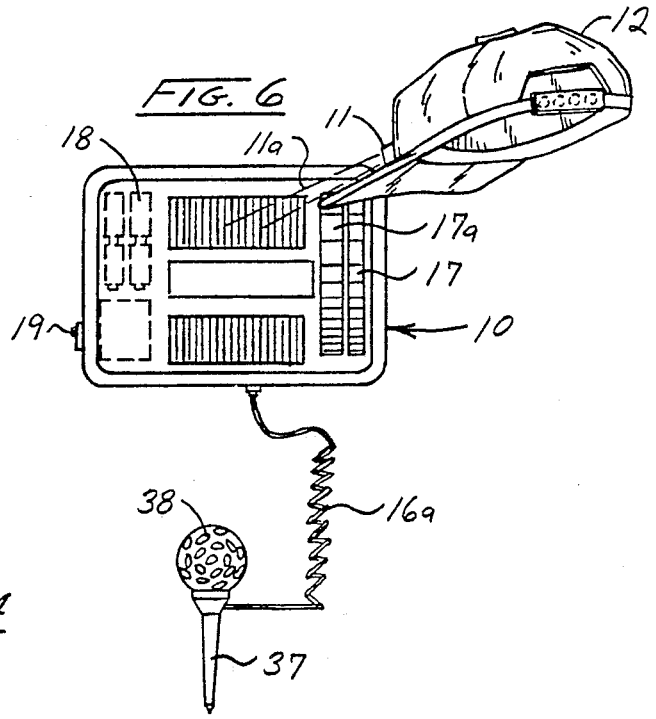
FIG. 6 is a plan view of the head position detecting device which is a part of this invention shown for outdoor use in conjunction with a golf tee.

Referring now more particularly to FIG. 6, the golf club tee 37 is shown holding a conventional golf ball 38, the golf tee 37 being connected to the unit 10 by means of line 16*a*. In use of the device shown in FIG. 6 when the ball 38 is hit with a conventional golf club the impact will cause the golf tee 37 which functions as a ball impact sensor to be actuated and this impulse will be transmitted to receptor 10 through line 16*a* in much the same way that the receptor 10 is connected to the recording device 15 for indoor use.

Figure 7:
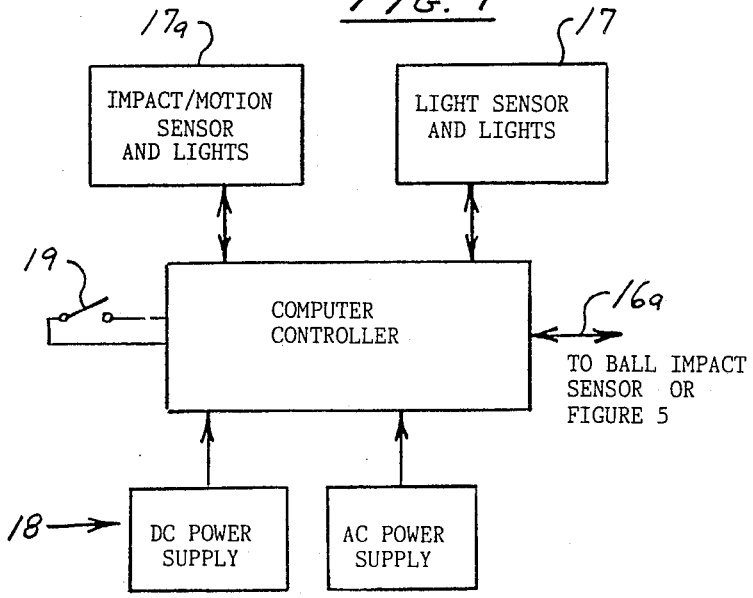
FIG. 7 is a schematic wiring diagram of the device shown in FIG. 6.

Referring now more particularly to FIG. 7, there is shown a detail of the schematic wiring diagram of the device shown in FIG. 6. The light detecting sensor and light display 17 and the impact motion sensor and light display 17*a* are shown connected to a computer controller with an appropriate on/off switch 19 provided with either a DC power supply when used in the field with a conventional golf club and ball, or when used, if desired, with an AC power supply. The computer controller is connected either to the golf tee ball impact sensor 37 or to the computer controller shown in FIG. 5 when used indoors. For outdoor use, as shown in FIG. 6, the beam 11*a* from the light source 11 on the hat 12 will reach the sensor 17 either before or after the ball 38 is hit by the club. Preferably the beam 11*a* will reach the sensor 17 after the ball is hit. For indoor use the simulated golf club 13 will be swung with the user being able to visually see the position of his club head 34 at the point of impact with the simulated golf ball 22 and the position of the infrared beams 35 and 36, whose location will be measured by sensor 22*a*, will determine whether or not the simulated golf ball 22 has been hit squarely. Distance traveled, swing path, and follow through of the swing will be measured by the various sensors 23, 23*a*, 24, and registered in the appropriate registers 21—21. Distance traveled, of course, will depend upon the club selected by means of club head selection switch 25*a*.

With the use of this device in practice by a golfer either inside his home or outside with a golf ball and a golf club, he can determine a number of things about the manner in which he probably swings his club and engages the ball. In the inside use of the device, he not only can determine whether or not his head is in the proper position at the point of impact of the simulated golf club 13, but the user will be able to determine the detailed position of his club head at the point of impact of the simulated golf club 13 with a simulated golf ball 22 as well as his swing path and follow through. This will immediately be displayed at his feet where he will be looking and also registered. Moreover, in addition to that, he will be able to determine whether or not his head is in the proper position when the simulated golf ball 22 has contact with the simulated golf club 13.

In use outdoors not as much information is generated. However, since the golfer will be hitting actual golf balls 38 with his golf club he will be able to determine for himself what happened to the golf ball after it was hit and he will be able to determine whether or not his head was in the appropriate position when the golf ball was hit.

While this invention has been described in its preferred embodiment, it is to be appreciated that variations therefrom may be made without departing from the true scope and spirit of the invention.

What is claimed:

1. An apparatus for the practicing of golf swings, comprising:

means to be worn on the head of the user for projecting a beam of radiation from the forehead of the user as the user swings a golf club;

a first detector means for detecting said beam of radiation, said first detector means including a visual display which will be actuated when said beam of radiation is detected by said detector means as the user swings a golf club.

2. The apparatus of claim 1 wherein said beam of radiation is a light beam.

3. The apparatus of claim 1 wherein said beam of radiation is a radio frequency beam.

4. The apparatus of claim 1 which includes a visual display which is lit when said beam of radiation is detected by said detector means.

5. The apparatus of claim 4 wherein said visual display includes an audio portion which will be actuated when said beam of radiation is detected by said first detector means.

6. The apparatus of claim 1 comprising in addition thereto:

an elongate member to be swung by a user in simulation of the swinging of a golf club;

said elongate member comprising a simulated golf club and being shorter than a conventional golf club but having approximately the same weight thereof, a source of conventional light and a source of infrared radiation contained within said elongate member, a beam of conventional light and two beams of infrared radiation extending from one end of said elongate member in an axial direction;

said conventional light beam displaying the outline of a simulated golf club head, one of said infrared beams positioned adjacent the heel of said simulated golf club head and the other of said infrared beams positioned adjacent the toe of said simulated golf club head, a simulated golf ball, a plurality of sensor means adjacent said simulated golf ball and responsive to said infrared radiation and disposed in a predetermined array for producing sensor signals in response to the passage of said infrared beams over said array during the swinging of said elongate member, said sensor signals lighting lights immediately adjacent thereto so as to provide a visual representation of the position of said simulated golf club head upon impact with said simulated golf ball, as well as the speed and direction of follow through of said golf club head.

7. The apparatus of claim 6 wherein means are included visually to display whether or not said first detector means is actuated before or after said simulated golf club head engages said simulated golf ball.

8. The apparatus of claim 7 which includes a visual display which is lit when said beam of radiation is detected by said first detector means.

9. The apparatus of claim 8 wherein said visual display includes an audio portion which will be actuated when said beam of radiation is detected by said first detector means.

10. The apparatus of claim 6 wherein said beam of radiation from the forehead of said user is a light beam.

11. The apparatus of claim 6 which includes a visual display which is lit when said beam of radiation is detected by said first detector means.

12. The apparatus of claim 6 wherein said visual display includes an audio portion which will be actuated when said beam of radiation is detected by said first detector means.

13. The apparatus of claim 1 comprising in addition thereto:

second detector means connected to said apparatus for detecting when a golf ball is hit by a golf club, means for comparing whether or not said first detector means is activated before or after said second detector means is activated, means for visually displaying the results of said comparison.

14. The apparatus of claim 13 wherein said second detector means is connected to a golf tee.

15. The apparatus of claim 14 wherein said visual display includes an audio portion for announcing the results of said comparison.

* * * * *